US007857171B1

(12) United States Patent
Christopherson

(10) Patent No.: US 7,857,171 B1
(45) Date of Patent: Dec. 28, 2010

(54) CONTAINER CONTENTS TRANSFER SYSTEM

(76) Inventor: Jerry Christopherson, 2446 Wallace Ave., Spartanburg, SC (US) 29302

( * ) Notice: Subject to any disclaimer, the term of this patent is extended or adjusted under 35 U.S.C. 154(b) by 1063 days.

(21) Appl. No.: 11/606,443

(22) Filed: Nov. 30, 2006

(51) Int. Cl.
*B67D 7/58* (2010.01)

(52) U.S. Cl. ..... 222/256; 222/92; 222/95; 222/105; 222/252; 222/386; 222/391; 222/360; 222/319; 222/341; 222/464.1

(58) Field of Classification Search ..... 222/92, 222/95, 96, 103, 105, 252, 254, 256, 259, 222/319, 336, 340, 341, 344, 359, 360, 386, 222/387, 391, 464.1, 464.3
See application file for complete search history.

(56) References Cited

U.S. PATENT DOCUMENTS 2,234,585 A * 3/1941 Wilson ..... 452/40
3,220,615 A * 11/1965 Spatz ..... 222/252
4,168,787 A * 9/1979 Stamper ..... 222/256
4,298,144 A * 11/1981 Pressl ..... 222/256
4,674,186 A 6/1987 Galiano
4,898,304 A 2/1990 Bacon, Jr.
5,799,997 A 9/1998 Lehn et al.
5,850,938 A * 12/1998 Hebert ..... 222/51
5,878,925 A 3/1999 Denkins et al.
6,012,227 A 1/2000 Lent
2006/0131337 A1 6/2006 Mertins

FOREIGN PATENT DOCUMENTS

GB 2137480 10/1984
JP 2005-200841 7/2005

* cited by examiner

*Primary Examiner*—J. Casimer Jacyna
(74) *Attorney, Agent, or Firm*—Smith Moore Leatherwood LLP; Thomas W. Epting

(57) ABSTRACT

A system for use in association with a container and a pump having an intake for transferring semisolid material from the container. The apparatus includes a first element that is inserted into the container and a second element that is also inserted into the container and moves the semisolid material with respect to the first element. An actuator moves the second element together with the semisolid material towards the intake of the pump. A method for use in transferring semisolid material from the container is also disclosed.

2 Claims, 9 Drawing Sheets

CONTAINER CONTENTS TRANSFER SYSTEM

BACKGROUND OF THE INVENTION

This invention relates generally to a system for transferring the contents from a container, and in particular, semisolid contents.

Numerous semisolid products are packed into containers, such as plastic buckets, having a generally cylindrical shape. Such semisolid products could include industrial products, such as grease, food products, such as shortening, construction products, such as joint compound, etc.

The semisolid products, when needed, may be scooped out of such containers, dumped out of the containers, and/or pumped out. However, with a pumping operation, it may be necessary to frequently interrupt pumping due to the pump cavitating if an air pocket forms in such semisolid material. This often times requires the user to manually stir and move the semisolid material in the bucket to eliminate such air pockets so that pumping can continue.

Such pumps typically include an intake pipe or tube that is inserted into the semisolid material. Aside from the issues with cavitation of the pump, once the level of semisolid material in the container falls to a certain point, it can be below the intake of the inlet to, such that pumping of the semisolid materials stops. At this point, it may be necessary to tilt the container to raise the level of the semisolid material, which may also require manual stirring by the worker, in order to allow still more of the material to be pumped. Alternately, the remaining material could be scooped out manually, or simply discarded. In any event, it may become time consuming to try and reclaim the residual semisolid material remaining in the container. This issue can cause particular inefficiencies in operations where the semisolid contents of the container are being used at a point distant from the container. For example, in application of sheetrock joint compound, the joint compound may be carried in a container and pumped from the container into an applicator, and then the applicator carried to a remote location, where a contractor uses the joint compound in installing the sheetrock.

Should the pump cavitate, or cease pumping because the level of the joint compound drops below the inlet of the intake tube, the operator must stop work, and go tend to the container in order that application of the joint compound may continue. A similar issue could arise in applications where another semisolid material, such as, for example, grease is applied at a remote location from a grease-filled container.

Accordingly, a system for improving the efficiency of dispensing semisolid materials from containers would be desirable.

SUMMARY OF THE INVENTION

Generally, one preferred embodiment of the present invention includes an apparatus for use in association with a container and a pump having a conduit with an intake for transferring semisolid material from the container. The apparatus includes a first element that is inserted into the container and a second element that is inserted into the container and moves the semisolid material with respect to the first element. An actuator moves the second element together with the semisolid material towards the intake of the pump.

More specifically, one preferred embodiment of the present invention includes the second element being configured for pivotal movement between a retracted position generally adjacent the first element, and an extended position generally adjacent the intake of the pump. A releasable latch automatically retains the second element in the retracted position upon the second element being moved to the retracted position, the releasable latch being configured, upon release, to initiate the actuator to move the second element towards the extended position. An indicator moves with the second element between the retracted and extended positions and indicates the approximate amount of the semisolid material in the container. A is provided cover covers a substantial portion of the container, and at least one releasable clamp selectively attaches the cover to the container.

The present invention further includes a method for use in association with a container and a pump having an intake for transferring semisolid material from the container, the method including providing first and second panels and inserting them into the container, and then moving the semisolid material with the second panel towards the intake of the pump while simultaneously holding the first panel generally stationary.

It is to be understood that the present invention can find use and application in the transfer of liquids and granular materials, powdered materials, particles and/or particulate materials, fluidized bed-type materials, sand, grain, flour, cement, and the like, and as used herein, the term "semisolid" shall refer to and include all of the foregoing materials.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
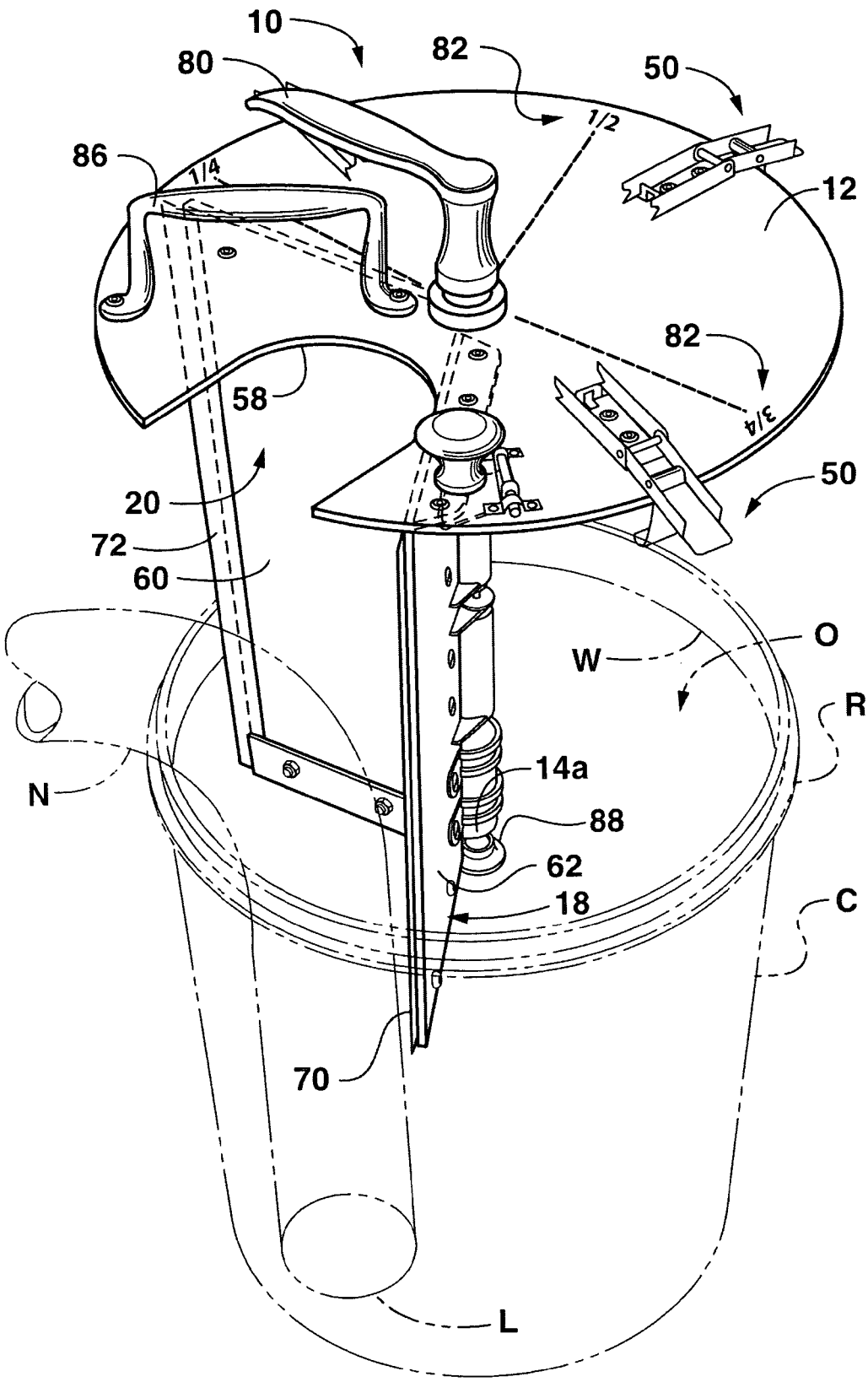
FIG. 1 is a perspective view of a container content transfer system constructed in accordance with the present invention, substantially removed from a container.

The foregoing, as well as other objects of the present invention, will be further apparent from the following detailed description of the preferred embodiment of the invention, when taken together with the accompanying drawings and the description which follows set forth this invention in its preferred embodiment. However, it is contemplated that persons generally familiar with material handling will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the container content transfer system of one preferred embodiment of the present invention is indicated generally in the figures by reference character 10.

Figure 2:
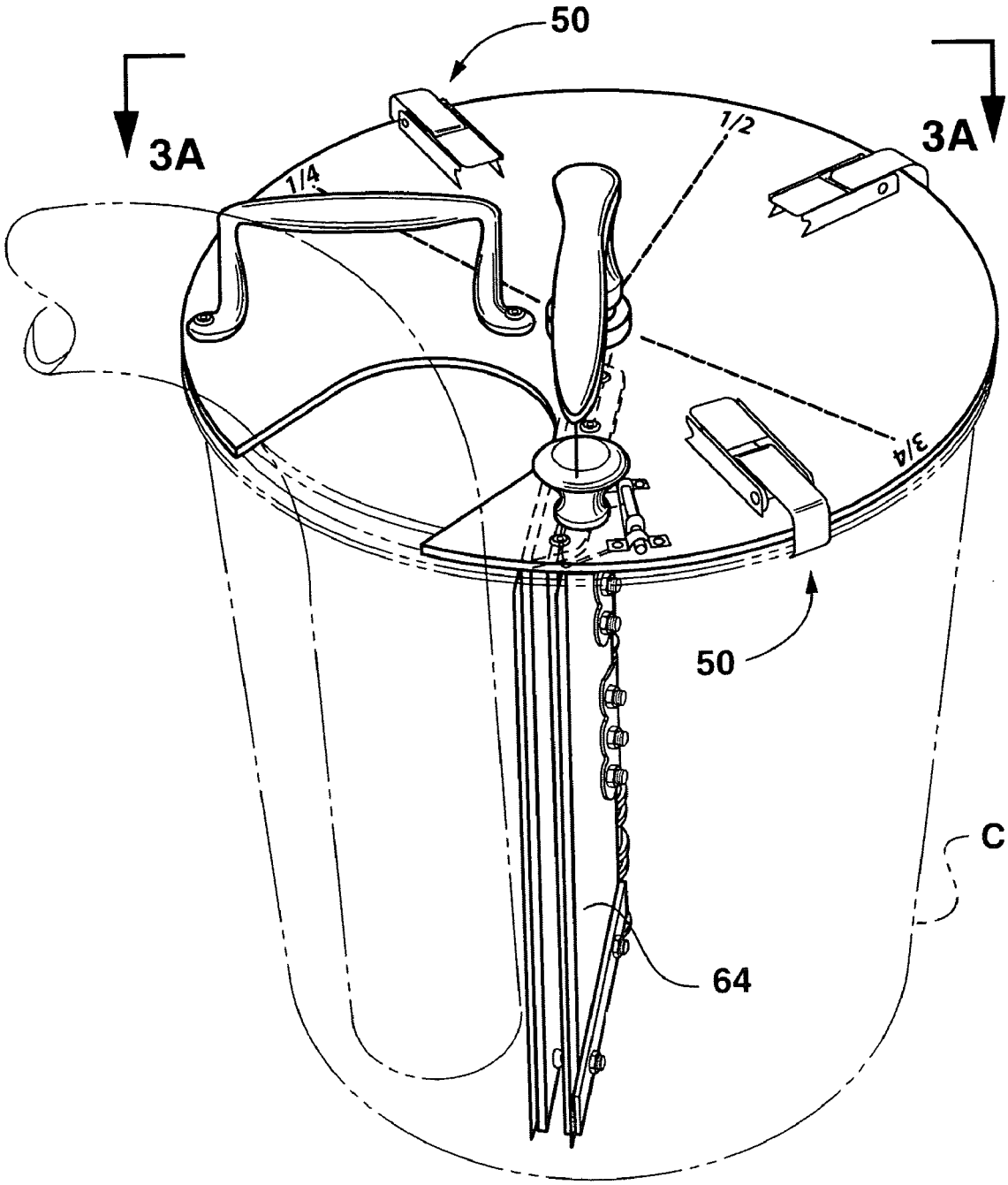
FIG. 2 is a perspective view of the container contents transfer system illustrated in FIG. 1, positioned within a container.

Turning to FIG. 1 of the drawings, container contents transfer system 10 includes a cover, generally 12, and elongated axles, or axle members, generally 14*a* and 14*b* (FIG. 5), depending generally perpendicular downwardly from cover 12. Generally fixedly mounted to axles 14*a* and 14*b* is a first element, or panel, generally 18, which is of a generally rectangular shape and is constructed of relatively rigid material, such as metal, plastic, fiberglass, wood, or some other suitable material. A second element, or panel, 20 is of similar construction, in one preferred embodiment. However, second, or movable, panel 20 pivots about axles 14*a* and 14*b* with respect to panel 18 between a retracted position, as shown in FIG. 2 to a generally extended position, as shown in FIG. 1.

Figure 5:
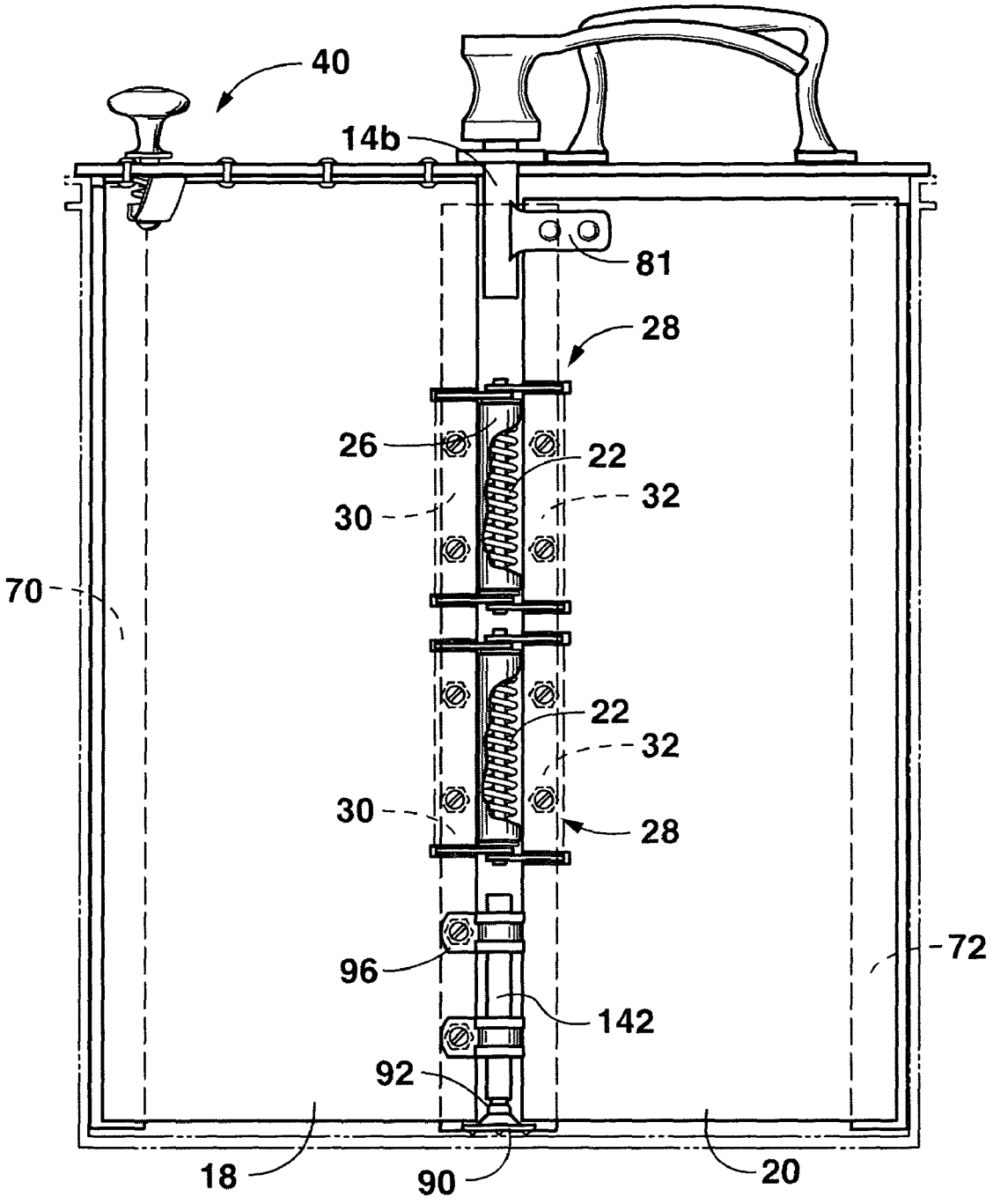
FIG. 5 is a sectional view taken along lines 5-5 of FIG. 3B.

Moveable panel 20 is moved by an actuator, generally A, which could be a biasing element such as torsion springs 22, and although not shown, an elastic band, coil spring, wire spring, or some other biasing member. Additionally, although not shown, actuator A could be powered and could be a motor, stepping motor, solenoids, or some other suitable motive force source. Torsion springs 22, as shown in FIG. 5, can be carried I a barrel portion 26 of spring hinges, generally 28, with a plate, or flange, 30 of each hinge being attached to first panel 18, and a flange 32 of each hinge being attached to movable panel 20. Although two spring hinges 28 are shown, it is to be understood that more or less such spring hinges can be used, depending on the desired application of system 10.

In an overview of the general operation of container contents transfer system 10, panels 18, 20 are inserted into a container, generally C, containing semisolid material, generally S (FIGS. 6A through 6D). Upon insertion into container C, movable panel 20 is in its retracted position (FIG. 2), and is held in that position by a latch, generally 40.

Figure 4:
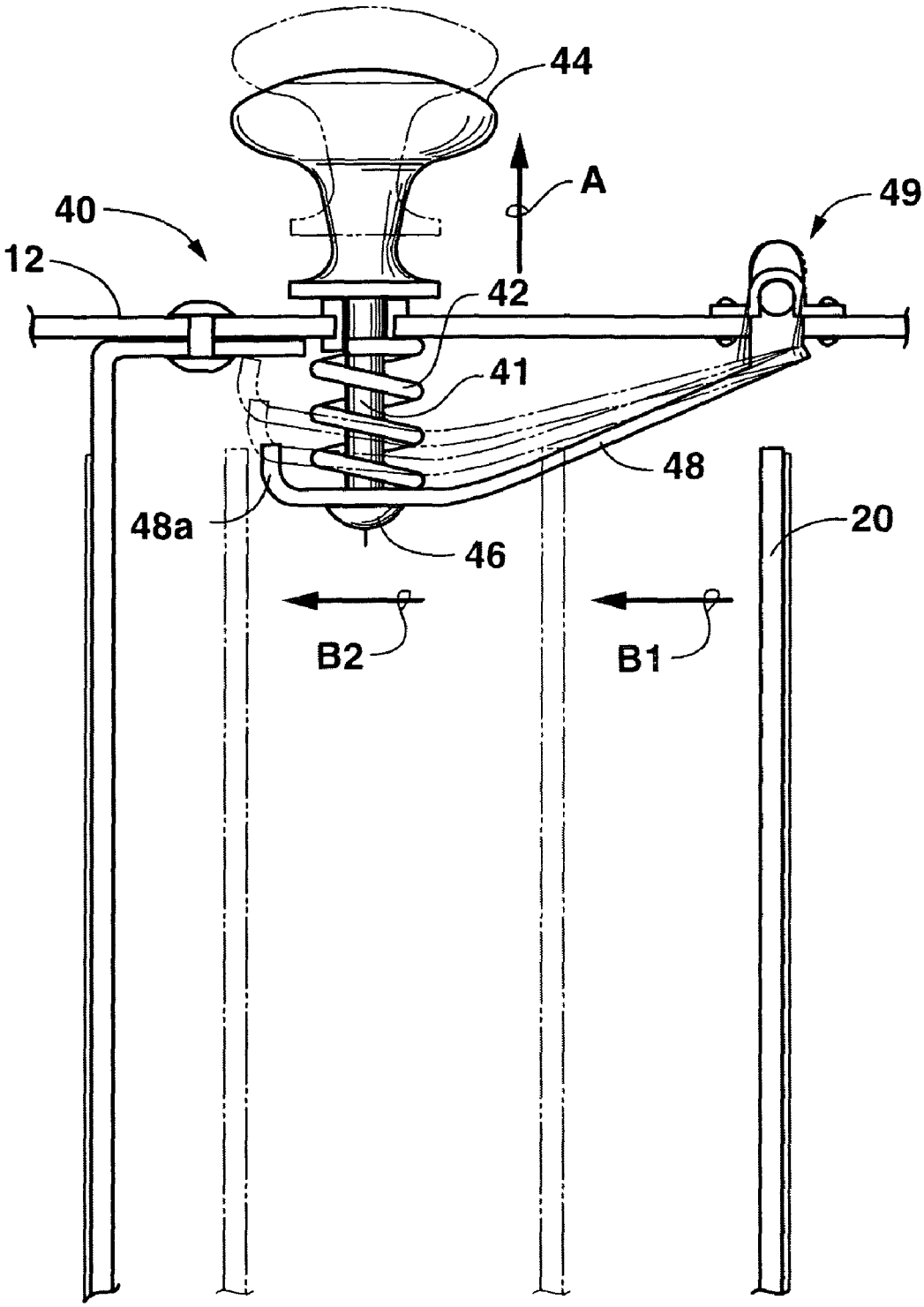
FIG. 4 is a sectional view taken along lines 4-4 of FIG. 3A.

As shown in FIG. 4, latch 40 is biased towards a position for latching panel 20, and includes a biasing member, such as coil spring 42. Latch 40 also includes a knob 44 for selective actuation of latch 40, and a shaft 41 about which coil spring 42 encircles. At the distal end of shaft 41 is an enlarged head 46 which retains a pivot plate 48, pivot plate 48 being pivotally attached to cover 12 by a pivot arrangement, generally 49. The end 48*a* of pivot plate 48 engages with and keeps movable panel 20 in the retracted position, against the force of torsion springs 22. Upon knob 44 being lifted in the direction of arrow A a sufficient distance such that end 48*a* of pivot plate 48 clears the upper edge of panel 20, panel 20 is released and is impelled forward towards the extended position by torsion springs 22.

Latch 40 is configured such that upon movable panel 20 being moved in the direction of arrows B1 and B2 to the retracted position, latch 40 automatically engages panel 20 to maintain panel 20 in the retracted position.

As shown in FIGS. 1, 2, 3A, and 3B, clamps 50 are attached to the rim R about the opening O of container C and releasably attach cover 12 to container C.

Upon cover 12 being secured to container C, and a pump intake, generally N, being inserted into container C through a recess, generally 58, of cover 12, latch 40 can be released. The spring force of torsion springs 22 is preferably selected such that sufficient force is provided movable panel 20 to cause it to move the semisolid material towards pump intake N. However, the spring force of torsion springs 22 should not be so strong as to cause movable panel to force the semisolid material upwardly and outwardly through recess 58 of cover 12. Depending on the type of semisolid material to be transferred from container C, the spring force exerted upon movable panel 20 by torsion springs 22 may be varied as desired, and as to perform satisfactorily in the particular application.

As a pump (not shown) draws the semisolid material from container C through intake N, the volume of semisolid material in container C decreases accordingly, and movable panel 20 moves towards its extended position (FIG. 1), thereby collecting and gathering the semisolid material and, moving it to the area adjacent intake N. This maximizes the semisolid material available at any time to the inlet L of intake N and thus reduces the likelihood of air pockets being formed and cavitation occurring in the pump and/or the intake N. As movable panel 20 moves, it preferably leaves a substantial void of the semisolid material between its back side 60 and the front side 62 of first panel 18. Also, as movable panel 20 moves, and the front side 64 thereof collects and pushes the semisolid material toward the back side 66 of panel 18, panel 18 serves to block, or act as a dam, generally preventing the semisolid material from leaving the area from which inlet L draws in the semisolid material.

Each of panels 18, 20 include elongated, resilient seals, or wipes, 70, 72, respectively, which engage the interior wall W of container C. Wipe 70 of panel 18 serves to restrict the semisolid material from bypassing panel 18 as panel 20 forces the semisolid material towards the area about inlet L of intake N. Similarly, wipe 72 on movable panel 20 wipes and substantially clears the semisolid material which may otherwise adhere to the wall W of container C as panel 20 pivots on axles 14*a*, 14*b* in traveling from the retracted position to the extended position. Although not shown, Additional elongated wipes could also be provided on the bottom edges of panes 18 and 20, if desired, to further restrict the bypass of semisolid material beneath panels 18 and 20.

Accordingly, the operation of system 10 is initiated by knob 44 of latch 40 being pulled upwardly, thereby initiating the action of torsion springs 22 to impel panel 20 from the retracted position towards the extended position, which in turn, forces the semisolid material to the zone of the inlet L of intake N.

Figure 3A:
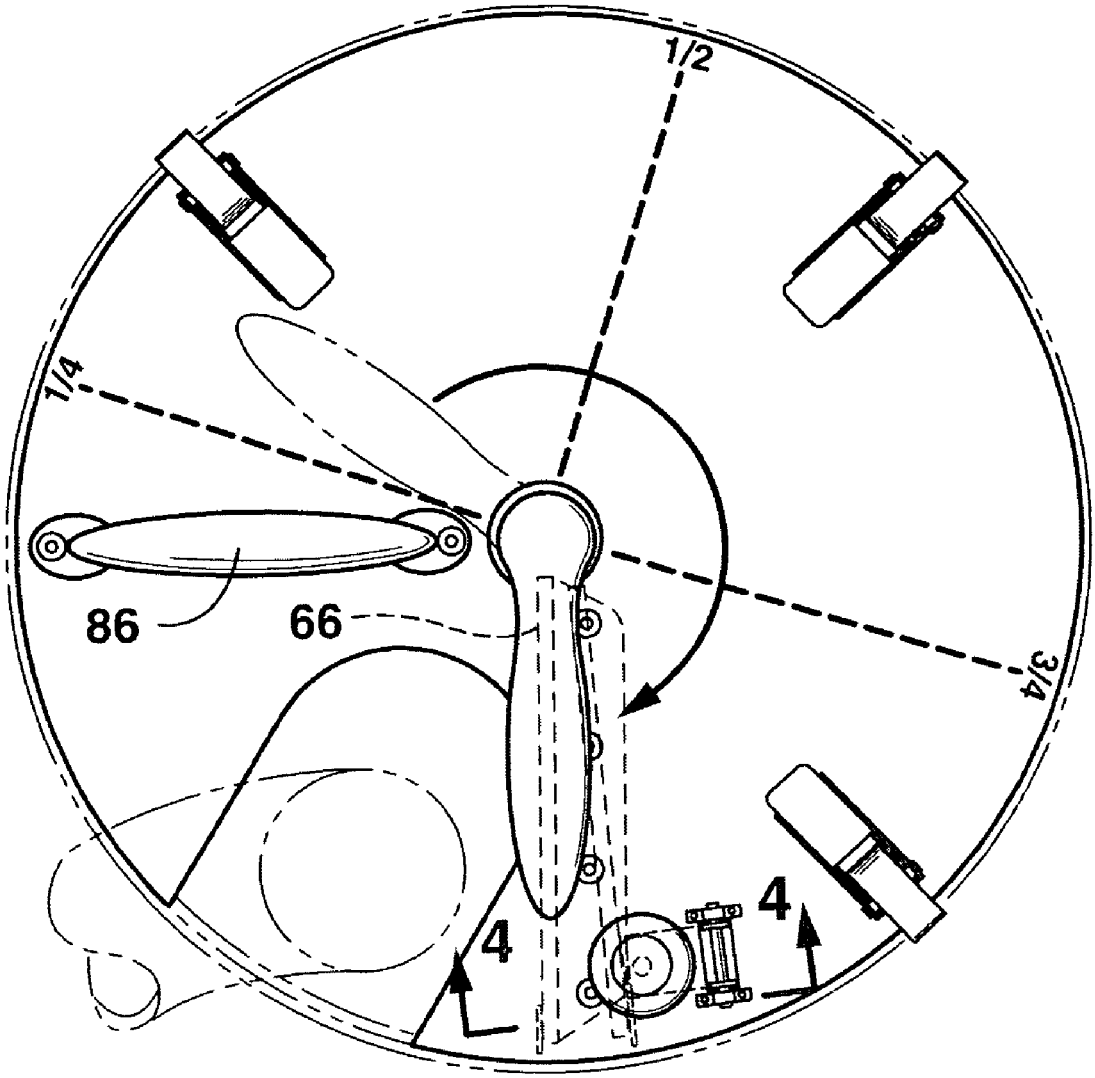
FIG. 3A is a view taken along lines 3A-3A of FIG. 2.
Figure 3B:
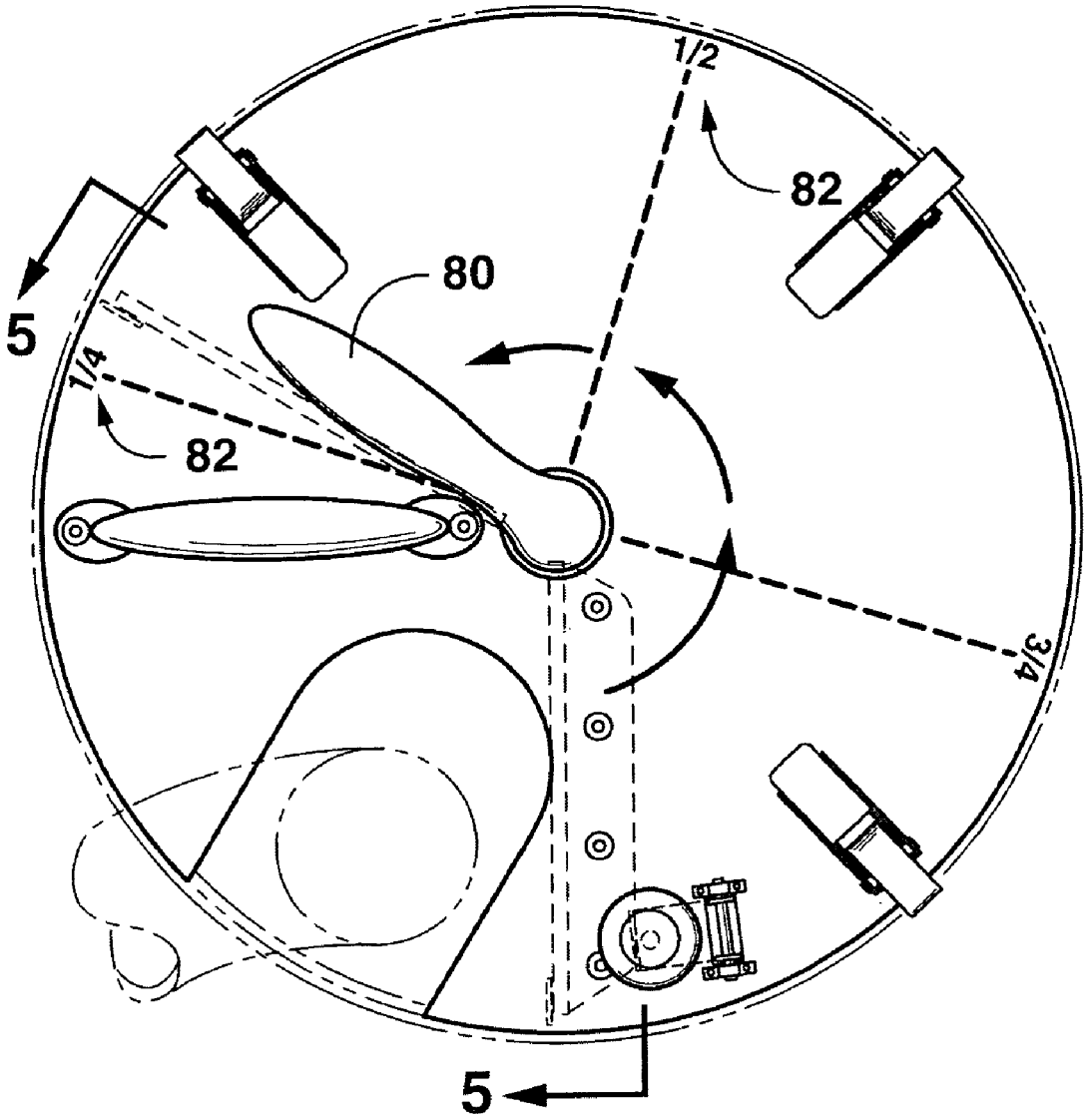
FIG. 3B is a plan view of the container contents transfer system illustrated in FIG. 1.

System 10 includes an indicator, or pointer, generally 80 which is connected to panel 20 via flange 81 (FIG. 5) for movement with panel 20. Markings, or other indicia, generally 82, are provided on cover 12 for indicating the approximate amount of semisolid material remaining in container C as panel 20 pivots from the retracted to the extended position. Thus, as shown in FIG. 3B, pointer 80 indicates that the amount of semisolid material in container C is somewhere between on fourth and one half the capacity of container C. Similarly, FIG. 3A illustrates pointer 80 at a position indicating container C has a level of semisolid material approximately at capacity.

A handle, generally 86, is attached to cover 12 to facilitate transport of system 10 and also installation of and removal of system 10 with respect to container C.

System 10 of the present invention is not limited to the embodiments shown herein, but in one preferred embodiment, system 10 is used in connection with standard five gallon plastic buckets. It is to be understood, however, that container C could be any of a number of other types of containers. When system 10 is used with such plastic buckets, an adjustable foot member, generally 88, having sharp projections or spikes (FIG. 5), generally 90, can be provided, for positioning axle 14*a* properly with respect to the bottom B of container C. Spikes 90 would slightly penetrate bottom B of a plastic bucket to generally fix axle 14*a* with respect to bottom B. Axle 14*a* is preferably positioned such that moveable panel 20 is free to move from its retracted position to its extended position. Foot member 88 can have a threaded shaft 92, which is received within a threaded bore of axle member 14*a*, to allow for varying of the spacing between panels 18, 20. Panel 18 is attached to axle 14*a* via clamp members 96.

Figure 6A:
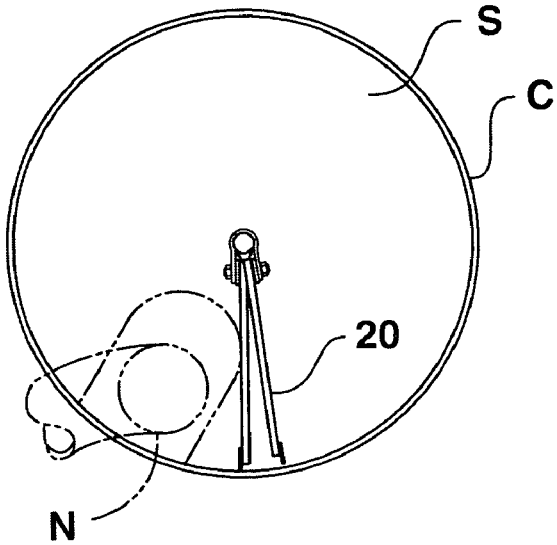
FIGS. 6A-6D are sectional views illustrating operation of a container contents transfer system constructed in accordance with the present invention.
Figure 6B:
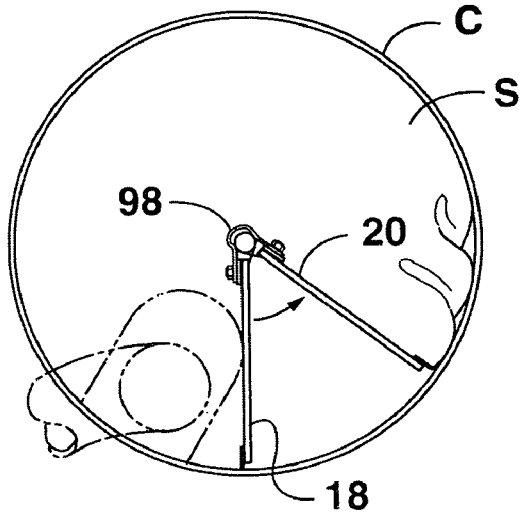
Figure 6C:
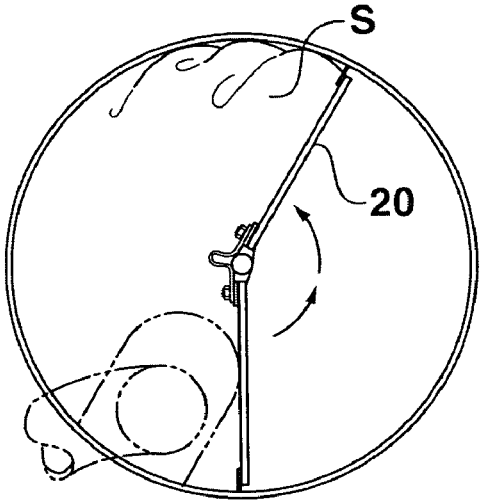
Figure 6D:
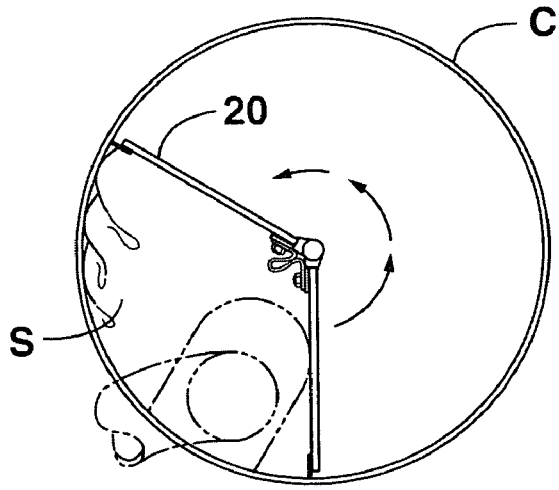

FIGS. 6A through 6D illustrate operation of system 10, and in particular, movement of panel 20 from the retracted position, as shown in FIG. 6A, to the fully extended position, as shown in FIG. 6D. As panel 20 moves from the retracted position, as noted above, it collects and forces the semisolid material S in front of it towards intake N, leaving a space substantially free of the semisolid material behind panel 20 as it moves to the extended position. A wrap, shield, or guard, generally 98, is provided for substantially covering axle members 14*a*, 14*b* and hinges to restrict influx of the semisolid material to those components.

Figure 7:
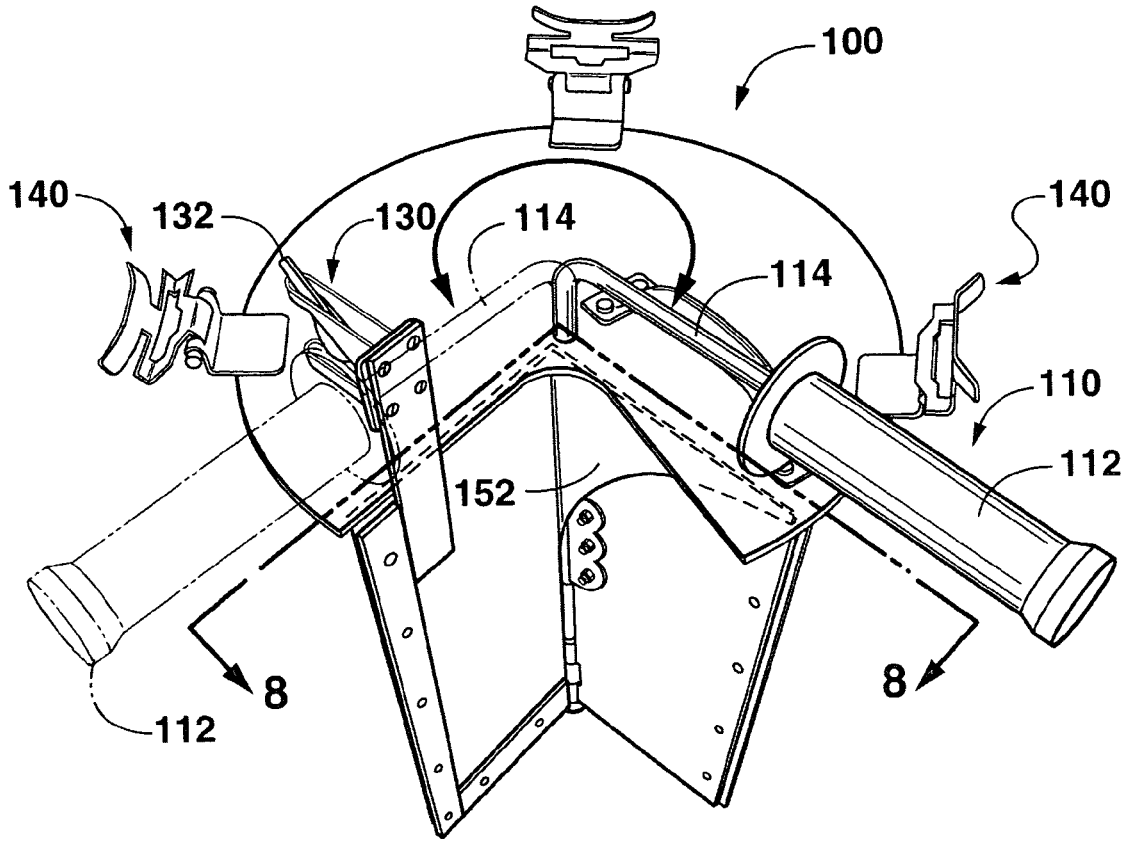
FIG. 7 is a perspective view of an alternate embodiment container contents transfer system constructed in accordance with the present invention.
Figure 8:
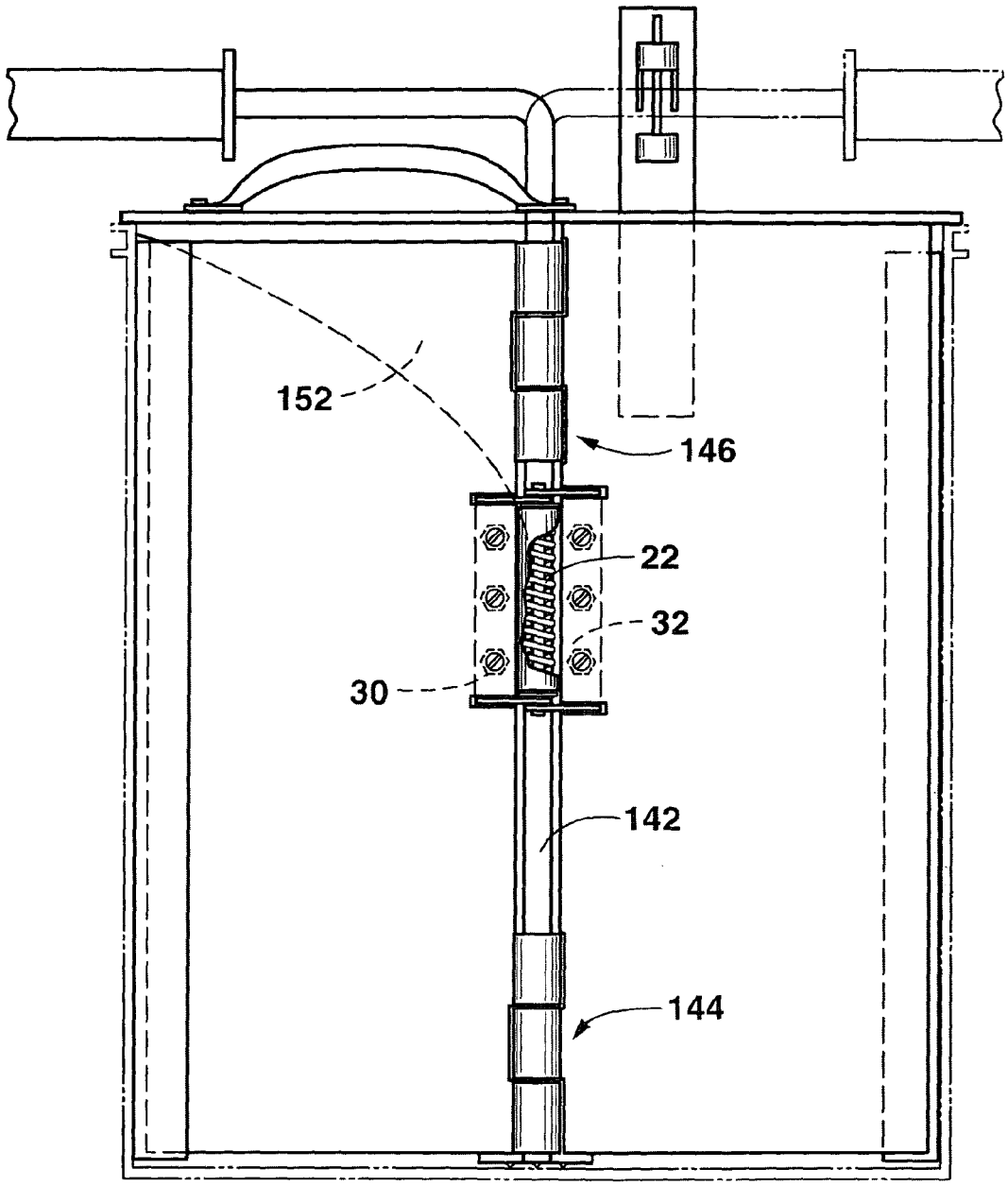
FIG. 8 is a front elevational view of the container contents transfer system illustrated in FIG. 7.

FIGS. 7 and 8 illustrate an alternate embodiment of a container contents transfer system 100 constructed in accordance with the present invention. In this embodiment, an indicator, or pointer, arm, generally 110, is provided having a handle, generally 112, and a shaft portion, generally 114. When moveable panel 20 is in the retracted position, shaft portion 114 is received within a gate-type latch, generally 130, which holds shaft 114. Latch 130 includes a release finger 132 which, when pivoted, releases shaft 114. Since shaft 114 is fixedly attached to moveable panel 20 for movement with panel 20, latch 130 also holds moveable panel 20 in the retracted position.

System 100 also includes releasable clamps 140 which are of a different configuration then clamps 50. It is to be understood, however, that the construction of clamps 140 for cover 12 could take on a variety of forms, and that clamps 140 are not to be limited to the particular embodiments shown herein. Other releasable clamps would also provide adequate holding capabilities for attaching cover 12 to container C.

As shown in FIG. 8, instead of axle members 14*a*, 14 *b*, a single axle 142 is provided in system 100, as are also hinge members, 144, 146. Hinge 144 is connected to the base of panels 18, 20 and hinge 146 is connected to the upper end of panels 18, 20. A single torsion spring 22 enclosed in a hinge 28 is provided. Torsion spring 22 biases the hinge plate 32 attached to moveable panel 20 away from the hinge plate 30 attached to hinge plate 18.

Movable panel 20 in system 100 may include a reinforcement plate 152, if desired, to strengthen upper portion of panel 20.

Accordingly, container contents transfer systems and 100 of the present invention provide systems for enhancing transfer of a semisolid material from a container to a pump intake by minimizing the likelihood of pump cavitation and by gathering together and presenting to the intake inlet semisolid material oftentimes left behind, thereby maximizing the use of the semisolid material and reducing waste and manpower requirements.

It is to be understood that while the present invention has heretofore been disclosed in certain instances for use in connection with the'transfer of a semisolid material such as sheetrock joint compound, such is for illustration purposes only, and the present invention, as noted above, could also find use and application in the transfer of other semisolid materials, such as liquids, granular materials, powdered materials, particles and/or particulate materials, fluidized bed-type materials, sand, grain, flour, cement, and the like, and as used herein, the term "semisolid" shall refer to and include all of the foregoing materials.

While preferred embodiments of the invention have been described using specific terms, such description is for present illustrative, purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. An apparatus for use in association with a container and a pump having an intake for transferring semisolid material from the container, the apparatus comprising:

a first element that is inserted into the container;

a second element that is inserted into the container and that moves the semisolid material relative to said first element;

an actuator that moves said second element together with the semisolid material towards the intake of the pump;

said second element being configured for pivotal movement between a retracted position generally adjacent said first element, and an extended position generally adjacent the intake of the pump; and said actuator is a hinge having a torsion spring.

2. An apparatus for use in association with a container and a pump having an intake for transferring semisolid material from the container, the apparatus comprising:

a first element that is inserted into the container;

a second element that is inserted into the container and that moves the semisolid material relative to said first element;

an actuator that moves said second element together with the semisolid material towards the intake of the pump;

an axle member;

said second element being configured for pivotal movement on said axle member between a retracted position generally adjacent said first element, and an extended position generally adjacent the intake of the pump;

said actuator being hinge having a torsion spring; and a shield that substantially restricts the semisolid material from said axle member, said hinge, and said torsion spring as said second panel moves between said retracted position and said extended position.

* * * * *